United States Patent [19]

Rayfield et al.

[11] 4,242,769

[45] Jan. 6, 1981

[54] ANTI-EXPOSURE INFLATABLE STRUCTURE

[75] Inventors: John F. Rayfield, Dover, Del.; John D. Schieble, Chestertown, Md.

[73] Assignee: ILC Dover, a division of ILC Industries, Inc., Frederica, Del.

[21] Appl. No.: 969,380

[22] Filed: Dec. 14, 1978

[51] Int. Cl.[3] ..... B63C 9/08; A41D 13/02

[52] U.S. Cl. ..... 9/330; 2/79; 2/82

[58] Field of Search ..... 2/79, 82, 69, 2, 2.1 R, 2/2.1 A, DIG. 3; 9/329, 330, 331, 332, 340, 341, 342, 343, 344

[56] References Cited

U.S. PATENT DOCUMENTS

| | | | |
|---|---|---|---|
| 1,167,930 | 1/1916 | Rasmussen | 9/342 |
| 2,608,690 | 9/1952 | Kolb et al. | 9/341 X |
| 4,023,223 | 5/1977 | Anderson et al. | 2/82 X |
| 4,181,993 | 1/1980 | McDaniel | 9/329 |

FOREIGN PATENT DOCUMENTS

| | | | |
|---|---|---|---|
| 2621422 | 11/1977 | Fed. Rep. of Germany | 2/82 |
| 600489 | 4/1948 | United Kingdom | 2/82 |

*Primary Examiner*—H. Hampton Hunter

*Attorney, Agent, or Firm*—Donald D. Denton

[57] ABSTRACT

An anti-exposure inflatable structure for reducing loss of heat from the body of a wearer, having spaced inflatable cavities with water vapor openings between cavities and an outer covering of a breathable, water-proof material loosely covering the outer surface of the structure, the structure having sealing means at its marginal edges to prevent water from entering between the body of a wearer and the structure.

17 Claims, 6 Drawing Figures

ANTI-EXPOSURE INFLATABLE STRUCTURE

BACKGROUND OF THE INVENTION

This invention relates to an inflatable protective spacer structure for reducing the loss of heat from the body of a wearer when subjected to a hostile cold environment. More particularly, the invention relates to an inflatable protective spacer assembly forming a part of an anti-exposure garment which when inflated protects the body of the wearer from excessive loss of body heat in a hostile, cold environment to provide a means for survival.

Anti-exposure garments are used particularly by airmen who are subject to accidental immersion in a cold sea where an excessive loss of body heat would be fatal. Accidental immersion of a person in cold water about 20° C. without immediate availability of rescue presents the lethal consequences of drowning and hypothermia.

Protection from drowning can be provided the airman having a proper flotation device; but hypothermia of airmen downed in a cold hostile environment is more difficult to avoid and is recognized as a major problem particularly in accidental immersion in cold water.

Anti-exposure suits now known in the art are based on three types of design concepts, namely dry with closed-cell foam; dry without closed-cell foam; and wet with closed-cell foam. These suits must be capable of being donned quickly and easily over regular clothing and of course they differ from diving suits since they are typically more bulky and loose fitting to the body.

One of the problems encountered in anti-exposure survival suits is the difficulty of providing for the passage of water vapor produced by the body through the heat insulating barrier that is providing retention of body heat so that the body heat loss is maintained at a minimal level. Also, the heat retention barrier must be of such construction that it does not hinder the movement and ability of the wearer to be mobile and perform manual operations.

Survival suits having foam heat retention spacers or liners not only restrict the manual functions of the body but also must provide additional means for proper dissipation of water vapor from the body of the wearer during use until survival protection is demanded.

The above discussed disadvantages are eliminated by anti-exposure inflatable structures of the present invention by providing an inflatable spacer formed from thin sheets of material that are impervious to the transmission of air therethrough and the sheets of material being capable of being sealed together along common edges and in spaced areas, with the sealed areas having a hole positioned in them to form a plurality of intercommunicating gas retention pockets or chambers which when inflated produce the inflatable spacer.

Advantageously, the inflatable spacer can be formed by heat sealing two thin sheets of water impervious material along contiguous edges and at spaced intervals within the confines of the edges to form the intercommunicating pockets or chambers. The spaced intervals may form a quilt-like configuration which, when an inflating gas is introduced into the closed pockets from a gas supply means that is operatively connected to one wall of the material, produces an inflated spacer that has a quilt-like surface. When the inflated spacer is placed in a garment construction that covers the body, it provides insulation and floatation to a wearer.

The inflatable spacer forming a part of an anti-exposure garment can be constructed so that it covers the body except for the hands, above the lower portion of the neck, and the feet, and has sealed to its marginal edges an outer loose covering layer of a breathable fabric that permits moisture vapor transmission through the fabric so that moisture vapor is transmitted away from the body of a wearer after first passing through the opening in the sealed areas of the spacer. Thus the wearer remains comfortable through dissipation of perspiration and his freedom to perform normal operations and duties is not impaired because there is an absence of bulkiness in this suit.

Advantageously, the inflatable spacer with its outer covering layer of breathable waterproof fabric can have a loose inner covering layer or liner of a lightweight fabric attached to it to form a spacer assembly. The lightweight inner liner aids in donning the spacer assembly.

The inflatable spacer, the water barrier of waterproof breathable fabric, and the lightweight fabric liner all may be bonded to the spacer at the wrist and lower neck areas and to a boot bladder, and have in the front body portion a waterproof closure that permits the donning of the spacer assembly. Such a construction forms a spacer assembly that prevents water from entering between the spacer assembly and that portion of the body of a wearer covered by the spacer assembly.

Thus, there is produced a spacer assembly that provides a flexible, noncompressible insulator garment and water barrier that, under normal wearing conditions, is not bulky or stiff so as to inhibit normal body movement, is light in weight, and provides normal body breathing for maximum comfort; but upon emergency demand, the garment can be converted into a thermal protective and flotation device by inflation to retain the body heat of the wearer to assist in his survival in a hostile cold environment, such as exposure in cold arctic of subarctic seas.

The closest art known to the inventors is the U.S. Pat. to Mauch No. 2,791,168 covering an inflated ventilating cover or blanket construction having two sheets of plastic material sealed together at their marginal edges and at spaced areas with jet holes for passing air from the inflated blanket against the body to provide for continuous air conditioning of the body. The air flowing through the orifice brought into contact with the body is exhausted through openings positioned in the sealed spaced areas. The inflatable spacer assembly of the present invention is an entirely different construction and functions in an entirely different manner since the construction of this invention provides for comfortable wearing of a spacer assembly that is inflatable to provide for the preservation of body heat when survival in a hostile, cold environment is demanded.

These and other objects will become apparent from the following description of a preferred embodiment and the drawings thereof, in which.

DESCRIPTION OF PREFERRED EMBODIMENT

Figure 1:
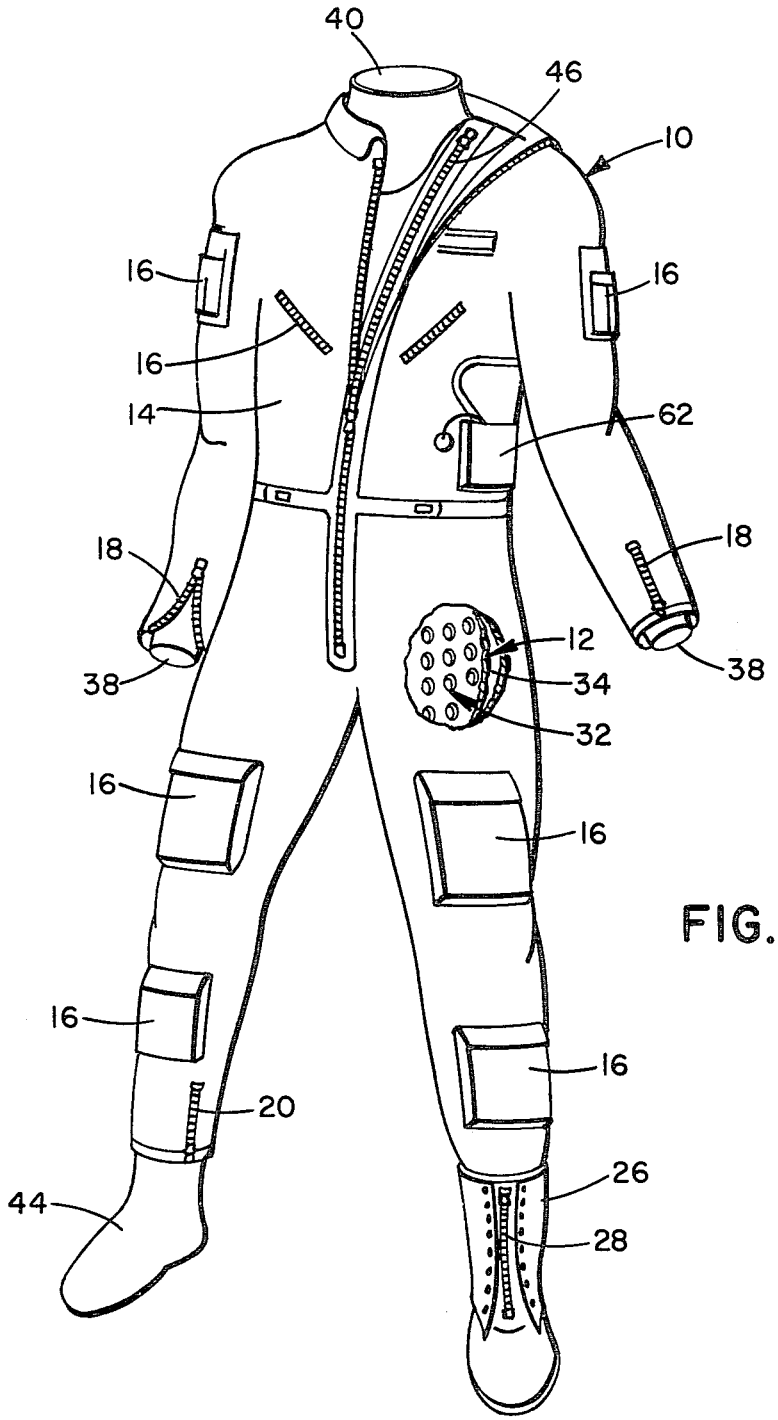
FIG. 1 shows an anti-exposure garment covering a body protective spacer assembly of this invention.
Figure 2:
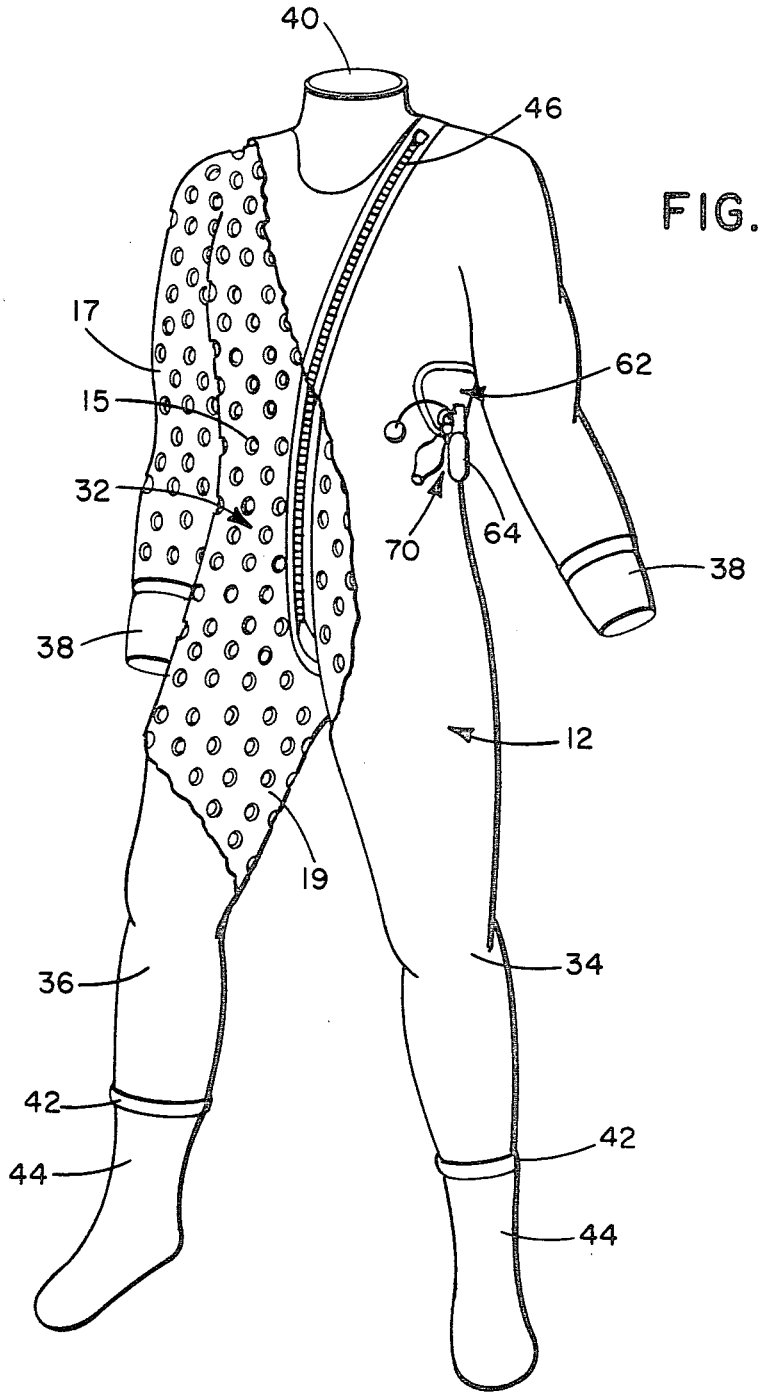
FIG. 2 shows the body protective spacer assembly with an inflatable spacer positioned between a waterproof breathable fabric loose outer cover and a loose soft lightweight inner liner.

FIGS. 1 and 2 illustrate an anti-exposure garment 10 having an inflatable spacer assembly or structure 12 covered by an outer shell or coverall to form an anti-exposure garment. The coverall 14 has utility pockets or attachments 16, watertight sleeve zipper or closures 18, watertight leg zippers or closures 20, an outer watertight shell closure 22 for closing the opening used for donning the outer shell 12. A boot 26 with a zipper or closure 28 is positionable on each foot of the wearer. The coverall garment 14 is made from a fabric material that is resistant to abrasion from rugged wear and is highly flexible and of light weight.

The inflatable spacer assembly has an inflatable spacer or bladder means 32 formed to the contour of the body, having a torso portion 15 with arm and leg portions 17 and 19. The spacer is tailored to fit the body except for the head, hands and feet of the wearer. Loosely covering the inflatable spacer 32 is a water barrier in the form of outer covering 34 formed from a breathable fabric that will permit body moisture in the form of water vapor to be transmitted through the fabric but will not substantially pass water in liquid form therethrough, and a soft lightweight fabric as an inner liner 36.

The outer covering 34 and the inner liner 36 in the form of loose coverings, with the spacer 32 positioned in between are joined together at the wrists, lower neck and lower leg portions of the spacer assembly. The outer covering 34 and the inner liner 36 have sufficient fullness of fabric so that the spacer 32 can expand without stressing the fabric. Attached to the spacer assembly are wrist seals 38, lower neck seal 40, and boot seal 42 which is attached to a boot bladder 44.

Positioned in the front of the spacer assembly is a donning sealing closure or zipper 46 for assembly of the spacer on the body of a wearer. The sealing closure 46 is in registry with the outer shell closure so that the anti-exposure garment can be removed quickly from the body of a wearer when desired.

Figure 3:
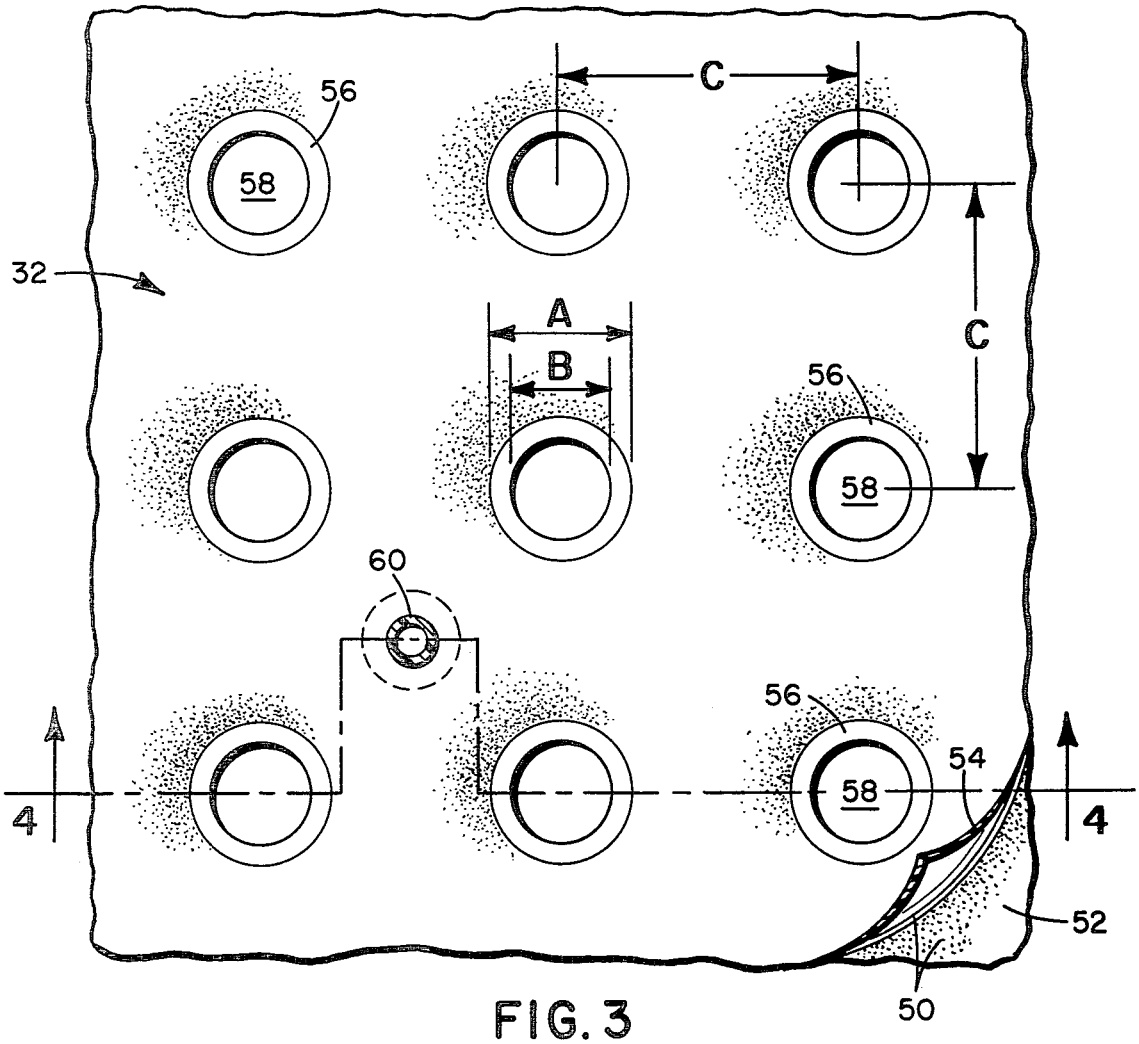
FIG. 3 shows an outer plan view of a segment of a spacer formed from two superimposed sheets of material with the arrangement of sealed areas for forming inflatable pockets.
Figure 4:
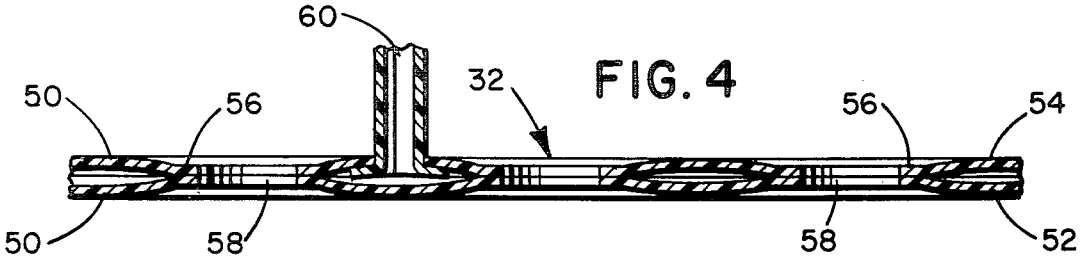
FIG. 4 is a cross-sectional view taken on the line 4—4 of FIG. 3 showing the construction of the conduit for conveying an inflating gas into the inflatable spacer from a gas supply means.
Figure 5:
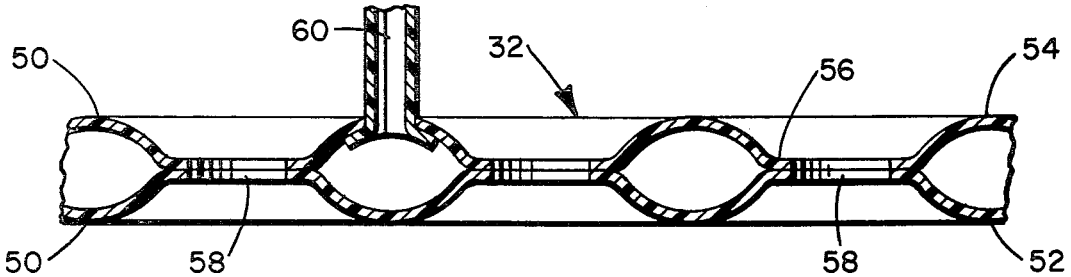
FIG. 5 is a cross-sectional view of the portion of the spacer shown in FIG. 4 inflated.
Figure 6:
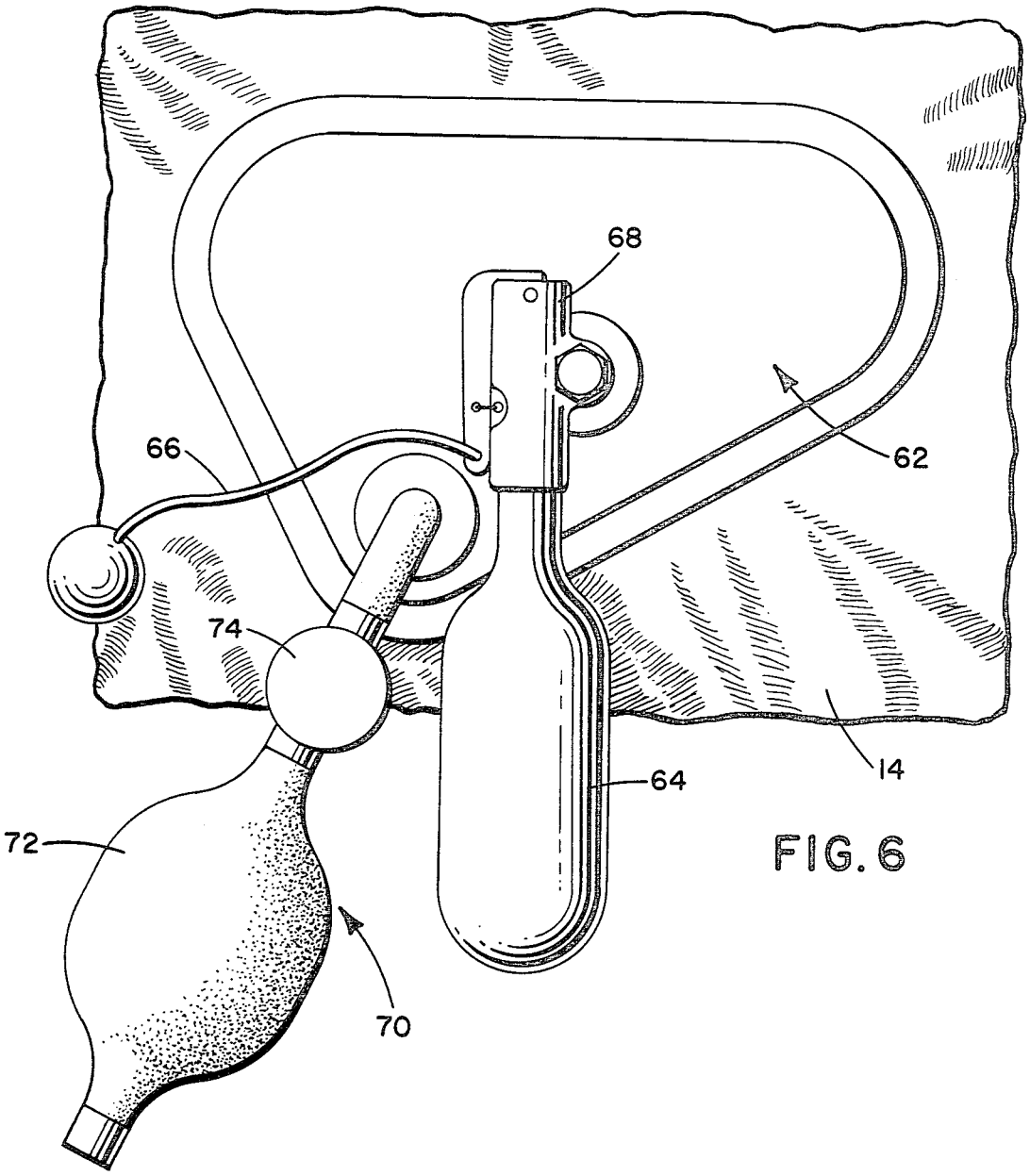
FIG. 6 is a plan view of gas supply means for inflating the spacer attached to outer coverall covering the spacer assembly.

In FIGS. 3, 4, and 5 is illustrated a segment of an inflatable spacer 32 formed from two thin sheets of a gas impermeable spacer material 50, such as urethane-type film, having an inner wall 52 and an outer wall 54 heat sealed together at contiguous edges and at spaced annular areas 56. Each annular area 56 defines an opening or orifice 58 for allowing the escape of water vapor from the body when the inflatable spacer 32 is positioned on the body. It will be appreciated that more than one opening can be defined by a heat sealed area. The heat sealed areas 56 are positioned in a pattern arrangement so that the openings are spaced over the entire portion of the body enclosed by the spacer assembly 12.

The inflatable spacer 32 has a conduit attachment or means 60 positioned in outer wall 54 of the spacer material 50 and in communication with pockets 55 formed between the unsealed areas and the inner surfaces of the inner and outer walls 52, 54 of the spacer 32. The conduit means 60 is operably and detachably connected to a gas producing means 62 which is attached to the outside of the coverall 14. The gas producing means may be in the form of a pressurized bottle 64 of inflating gas, such as a carbon dioxide cylinder, having a cord release means 66 which permits the wearer to manually operate a release of the gas in the cylinder through a valve means 68. Advantageously the gas producing means 62 may have a manually operated air pump means 70 having an inflation squeeze bulb 72 operably connected in the inflation gas producing means for manual inflation of the spacer in case of failure of the pressurized gas cylinder. Also, a deflation valve means 74 is provided to permit deflation of the inflated spacer if desired.

It will be appreciated that the inflatable spacer can be formed from any thin film or coated fabric material 50 that can be formed into an inflatable spacer or bladder and which can form a plurality of spaced sealed areas so that, when inflated, there is formed the plurality of spaced inflated pockets 55 that are in communication with one another. The spacer material 50 may be a urethane-type film or a urethane coated fabric or any other type of thin plastic film or plastic coated fabric in which adjacent walls are capable of being sealed or heat-sealed together at their marginal edges and at spaced intervals to form a plurality of sealed areas through which water vapor passage openings can be formed.

The water barrier material 34 in the form of the outer loose covering of the spacer assembly 12 may be formed from any type of water retardant, breathable material or laminated material that will prevent water penetration, and still pass air and water vapor. Typical of such a breathable material is "Gore-Tex"* laminate which consists of an expanded polytetrafluoroethylene film which contains myriad pores, each pore being smaller than a drop of water but larger than a molecule of water vapor.

*Product of W. L. Gore & Associates, Inc.

The thin lightweight inner liner 36 may be formed from any fabric that is compatible with the skin of the wearer and capable of providing comfort when worn. Also, the fabric inner liner 36 should have surface properties such that donning the spacer assembly over undergarments is not impeded by friction between the underclothing and the inner liner. Typical of such materials is "Nomex"** which is a soft lightweight fabric having a good hand.

**Product of E. I. du Pont de Nemours & Co., Inc.

It will be appreciated that the pattern of pockets in the inflatable spacer can have any geometric arrangement that provides intercommunicating inflatable pockets between the sealed areas that restrict ballooning of the total surface of the spacer. An inflatable quilt-like structure has been found to produce a good workable spacer assembly when gas is introduced into the spacer (see FIG. 4). It has been found that where annular sealed areas are used, an outer diameter A of from about $\frac{3}{8}$ inch to about 3 inches and an inner diameter B of from about $\frac{1}{4}$ inch to about 2 inches may be used; and where the spacing is on a rectangular coordinate pattern C, a spacing between the center of the opening taken in the direction of one of the coordinates may be from about 1 inch to about 5 inches (see FIG. 3). Also, each sealed area may have more than one opening therein, it being understood that the composite area of all such openings in a sealed area should be sufficient to pass the water vapor from the area of the body over which it is positioned to the outer side of the spacer so that the body can breath and can be comfortable during normal wearing when inflation is not needed to protect the wearer.

It will be appreciated that the inflatable spacer assembly of this invention can be formed from a composite of the inflatable spacer 32 and the loose outer breathable water resistant covering 34 sealed together at the outer margins at the wrist portion, lower neck portion, and lower leg portions. In this construction, the wearer would rely on underclothing if it is desirable to retain the inner surface of the inflatable spacer spaced away from the body to increase body comfort during wearing of the spacer assembly.

The anti-exposure garment 10 is assembled on the body by first entering the spacer assembly 12 when the watertight closure 46 in the upper torso portion 15 is open. The hands are pushed through the arm portions 17 and the wrist seals 38 and the feet extend through the leg portions 19 and into the waterproof boot bladders 44 which are sealed to the spacer assembly 12. When the closure/opening 46 is closed, the spacer assembly is positioned on the body such that if the wearer is immersed in water, the portion of the body covered by the spacer assembly and boot bladders is protected from contact with the water. The anti-exposure garment is completed by assembly of coverall 14 which is donned by entrance through outer shell closure/opening 22. A pair of boots are assembled on the feet of the wearer with the upper portion of the boot covering the extremities of the leg portion. The coverall is secured in place by closing of the outer shell closure, and the zippers in the cuff portions of each arm and the extremities of the leg portions. The boot zippers are closed to cover the bottom leg portions. The conduit means 60 is connected to the gas supply means during assembly of the coverall for supplying necessary inflation to the spacer when demanded.

With a proper helmet (device not shown), the wearer of the anti-exposure suit is protected against exposure to hostile cold environment, such as when downed in a cold sea where exposure to low water temperature for a short period of time is hazardous to life, and the suit also provides a flotation capability. The wearer can be protected by pulling the cord release means 66 to cause the discharge of the gas supply means 62 so that gas flows through conduit 60 into the spacer 32 to bring about its inflation. The inflated spacer provides an insulation barrier about the body of the wearer so that body heat is not dissipated, which increases chances for survival. In case of failure of an automatic inflation device, such as a carbon dioxide cylinder, the wearer can manually inflate the spacer by the air pump means 70 to inflate the spacer assembly.

It will be appreciated that the manually operated air pump means can be a device by which the inflation of the spacer device can be made by oral inflation.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. An inflatable body protective spacer assembly for reducing loss of heat from the body of a wearer when subjected to a hostile cold environment comprising: a spacer formed from an inflatable bladder means having inner and outer surfaces formed to fit a portion of the body and sealed at their contiguous edges, said bladder means having a plurality of sealed areas that form a plurality of intercommunicating inflatable cavities between said unsealed areas; at least one water-vapor-passing opening positioned in each of said sealed areas; a breathable fabric resistant to the passage of water therethrough loosely overlaying said outer surface of said bladder means with its edges sealed to the outer surface of the bladder means and covering said water-vapor-passing openings to prevent water outside the spacer assembly from entering between the body of the wearer and said bladder means but allowing body moisture that passes through said water-vapor-passing opening to pass through said breathable fabric; an inflation gas supply means operatively connected to said inflatable bladder means; and means for releasing gas from said supply means to inflate said bladder means when protection from loss of heat from the body of the wearer is demanded.

2. An inflatable body protective spacer assembly for reducing heat loss from the body of a wearer in a hostile cold environment comprising: an inflatable spacer adapted to cover the body of a wearer having an inner wall and an outer wall, said inner wall sealed to the outer wall at their contiguous edges and at spaced areas to form a quilt-like pattern with inflatable cavities therebetween, said sealed areas defining openings therein for the passage of water vapor from the body of a wearer to the outerside of said spacer; a breathable fabric loosely positioned over the outer wall of said inflatable spacer and sealed to the said contiguous edges of said inflatable spacer, said breathable fabric being capable of passing water vapor therethrough to allow body cooling by normal perspiration but being resistant to the passage of water from outside the spacer assembly, the looseness of said breathable fabric adapted to accommodate the expansion of said cavities during inflation; a conduit means operatively connected at one end to the outer wall of said inflatable spacer and communicating with said inflatable cavities, and at the other end detachably connected to a gas supply means; a watertight closure means positioned in said spacer assembly for donning said spacer by a wearer; watertight sealing means positioned around the lower neck, wrist, and lower leg areas of the said spacer assembly to prevent water from entering between the body of the wearer and the inner wall of the spacer; and means for actuating said gas producing means to supply inflating gas through said conduit means into the cavities of said spacer to inflate said spacer assembly when protection from loss of heat from the body of the wearer is demanded.

3. The inflatable body protective spacer assembly of claim 2 in which the said walls of said spacer are heat sealable thin plastic material.

4. The inflatable body protective spacer assembly of claim 3 in which said plastic material is urethane-type film.

5. The inflatable body protective spacer assembly of claim 2 in which said breathable fabric is a fabric coated with an elastomeric compound capable of passing water vapor but resistant to passage of water.

6. The inflatable body protective spacer assembly of claim 2 in which the thickness of said inner wall and outer wall of said spacer are each from about 5 mil to about 10 mil.

7. The inflatable body protective spacer assembly of claim 2 in which said gas producing means is a cylinder containing a high pressure gas, said cylinder having a manual release means for charging the gas into said spacer, and a manually operated air pumping means.

8. The inflatable body protective spacer assembly of claim 2 in which said spaced sealed areas are positioned on centers spaced about 1 to about 5 inches apart and each sealed area forming said quilt-like pattern has therein an opening equal to the area of a circle having a diameter of from about ¼ inch to 2 inches.

9. An anti-exposure garment for reducing heat loss from the body of a wearer when subjected to a hostile cold environment comprising:

(a) an inflatable spacer adapted to cover the body of a wearer having an inner wall and an outer wall of gas impervious material, the inner wall sealed to said outer wall at their contiguous edges and at spaced areas to form a quiltlike pattern of intercommunicating inflatable cavities therebetween, said spaced areas defining water-vapor-passage openings therethrough;

(b) a breathable fabric loosely positioned over the outer wall of said inflatable spacer and sealed to the said contiguous edges thereof to form a spacer assembly, said breathable fabric being capable of passing water vapor that passes through said water-vapor-passage openings but being resistant to the passage of water from outside said breathable fabric;

(c) an outer loose protective coverall positioned over said inflatable spacer assembly;

(d) an inflating gas supply means positioned on said coverall and operatively connected to said inflatable spacer by a conduit means;

(e) watertight closure means positioned in said spacer assembly and in said coverall for assembling said anti-exposure garment by a wearer;

(f) watertight sealing means positioned around the lower neck, wrist and lower leg areas of the spacer assembly to prevent water from entering between the body of the wearer and the spacer assembly; and (g) means for actuating said inflating gas supply means to charge inflating gas through said conduit means to inflate said cavities when protection from loss of heat from the body of the wearer is demanded.

10. The anti-exposure garment of claim 9 in which a loose thin lightweight liner is positioned on the body side of said inflatable spacer.

11. The anti-exposure garment of claim 9 in which each of said lower leg portions of said assembly is sealed to a watertight boot.

12. The anti-exposure garment of claim 9 in which said spacer is inflated.

13. The anti-exposure garment of claim 9 in which said sealed areas are positioned on centers spaced about 1 to about 5 inches from each other, said sealed areas forming said quilt-like pattern, each having an opening therethrough equal to the area of a circle having a diameter of from about ¼ to about 2 inches.

14. The anti-exposure garment of claim 9 in which said walls of said spacer are heat-sealable thin plastic material.

15. The anti-exposure garment of claim 9 in which said walls of said spacer are thin heat-sealable urethane-type material of from about 5 mil to about 10 mil in thickness.

16. The anti-exposure garment of claim 9 in which said gas supply means is a cylinder of carbon dioxide gas having a manual release means for charging the carbon dioxide gas into said spacer and a manually operated air pumping means.

17. The anti-exposure garment of claim 9 in which said gas supply means has a deflation valve means operatively connected thereto for deflating said spacer assembly.

* * * * *